US005216825A

United States Patent [19]

Brum

[11] Patent Number: 5,216,825

[45] Date of Patent: Jun. 8, 1993

[54] ODOR ADSORBING CONTOURED SUPPORT INNER SOLE

[76] Inventor: Kenneth A. Brum, 67 G.A.R. Hwy., Somerset, Mass. 02725

[21] Appl. No.: 822,670

[22] Filed: Jan. 21, 1992

[51] Int. Cl.[5] ..... A43B 13/40

[52] U.S. Cl. ..... 36/44; 36/154; 36/147

[58] Field of Search ..... 36/43, 44, 154, 71, 36/178, 181

[56] References Cited

U.S. PATENT DOCUMENTS

| | | | |
|---|---|---|---|
| 2,307,416 | 1/1943 | Margolin | 36/147 |
| 2,426,735 | 9/1947 | Hiss | 36/71 X |
| 3,244,177 | 4/1966 | Scholl | 36/154 |
| 3,828,792 | 8/1974 | Valenta | 36/178 |
| 3,842,519 | 10/1974 | Lapidus | 36/44 |
| 3,852,897 | 12/1974 | Bridge et al. | 36/44 |
| 4,062,131 | 12/1977 | Hsiung | 36/44 |
| 4,099,342 | 7/1978 | Singh | 36/44 |
| 4,137,110 | 1/1979 | Singh | 36/44 |
| 4,185,402 | 1/1980 | Digate | 36/44 |
| 4,186,499 | 2/1980 | Massok et al. | 36/44 |
| 4,192,086 | 3/1980 | Sichak | 36/44 |
| 4,223,458 | 9/1980 | Kihara | 36/44 |
| 4,235,027 | 11/1980 | Singh | 36/44 |
| 4,250,172 | 2/1980 | Mutzenberg et al. | 428/244 |
| 4,461,099 | 7/1984 | Bailly | 36/44 |
| 4,464,850 | 8/1984 | Ebert et al. | 36/44 |
| 4,689,899 | 9/1987 | Larson et al. | 36/44 |
| 4,694,589 | 9/1987 | Sullivan et al. | 36/154 X |
| 4,782,605 | 11/1988 | Chapnick | 36/154 X |
| 4,803,747 | 2/1989 | Brown | 36/154 X |
| 4,843,739 | 7/1989 | Blucher et al. | 36/44 |
| 4,864,740 | 9/1989 | Oakley | 36/44 |
| 5,154,960 | 10/1992 | Mucci et al. | 36/44 |

FOREIGN PATENT DOCUMENTS

| | | | |
|---|---|---|---|
| 0216727 | 4/1987 | European Pat. Off. | 36/44 |
| 2562396 | 10/1985 | France | 36/44 |
| 1145002 | 6/1989 | Japan | 36/44 |
| 1082382 | 9/1967 | United Kingdom | 36/44 |

*Primary Examiner*—Steven N. Meyers
*Assistant Examiner*—Ted Kavanaugh

[57] ABSTRACT

An odor adsorbing contoured laminate for footwear comprising an upper-most layer of perforated thermoplastic foam (20), a second layer of air permeable, water repellent textile fabric (22), a third layer of odor adsorbent material (24), a fourth partial layer of contoured solid thermoplastic (30), and a fifth bottom layer of odor adsorbent material (26).

8 Claims, 2 Drawing Sheets

ODOR ADSORBING CONTOURED SUPPORT INNER SOLE

BACKGROUND—FIELD OF INVENTION

This invention describes an inner sole or inner sock for footwear which is contoured on its upper surface and is comprised of thermoplastic foam, breathable water repellent fabric, odor adsorbent material, and solid thermoplastic material. It has odor adsorbing capability, resists saturation from perspiration fluid, and provides some structural support to the foot.

BACKGROUND—DESCRIPTION OF PRIOR ART

Odor adsorbing inner soles are commercially available in the form of a flat sheet of absorbent, compressible material. Such inner soles have a tendency to wrinkle and bunch up when subjected to shearing stresses imposed by the foot during walking. Lacking solid contoured material, they fail to provide anatomical structural support to the foot. By absorbing perspiration fluid, they quickly expend the efficacy of their odor adsorbent component.

A common embodiment has been a mixture of activated carbon powder contained within a latex rubber binder. U.S. Pat. Nos. 3,842,519 to Lapidus (1974), 3,852,897 to Bridge et al. (1974), 4,099,342 to Singh (1978), 4,137,110 to Singh (1979), 4,185,402 to Digate (1980), 4,223,458 to Kihara (1980), and 4,235,027 to Singh (1980) contain such an embodiment, usually in combination with layers of foam or fabric material in the form of a laminated flat sheet. Such flat sheets are designed to absorb into them perspiration fluid.

Other activated carbon containing inner soles lack an occlusive latex binder, but continue to retain a flat shape and continue to retain perspiration absorbing materials. U.S. Pat. No. 4,062,131 to Hsiung (1977) consists of a laminate of a fabric covering, a carbon impregnated felt mat intermediate layer, and a foam bottom layer. U.S. Pat. No. 4,186,499 to Massok et al. (1980) describes a woven fabric with at least one of its members being a filament impregnated with activated carbon. U.S. Pat. No. 4,192,086 to Sichak (1980) entails a perforated laminated inner sole which is perforated throughout all its layers and consists of a plastic fiber top covering, an intermediate layer of adsorbent charcoal paper, and a bottom layer of open cell foam needled together by incomplete stitch bonding. U.S. Pat. No. 4,250,172 to Mutzenberg et al. (1981) consists of alternating layers of fiber mat and granular carbon needled together. Such above mentioned patents share three common characteristics: (1) they are flat in shape, (2) they are made primarily of compressible materials, and (3) they absorb into them perspiration fluid.

U.S. Pat. No. 4,461,099 to Bailly (1984) describes a molded inner sole which contains a top layer of synthetic fabric, needle-punched into and through a middle layer of activated charcoal within a latex binder, and a bottom layer of thermoplastic foam. While such invention has a contoured rather than flat shape, it is compressible and lacks the structural integrity of a solid non-compressible base material in providing anatomical support to the foot structure upon weight bearing. This invention also shares the characteristic of other commercially available inner soles in that it is designed to absorb perspiration fluid.

U.S. Pat. No. 4,464,850 to Ebert et al. (1984) consists of compressible foam and is likewise designed to absorb perspiration fluid. This patent describes an upper layer of carbon containing textile fibers penetrating into and through an intermediate contoured layer of closed cell foam and a bottom layer of absorbent open cell foam or leather.

Absorption of perspiration fluid capability and flatness in shape continues in U.S. Pat. No. 4,689,899 to Larson et al. (1987), a textile fiber absorbent top layer laminated to a polyester fiber intermediate layer and a bottom layer of closed cell foam; and in U.S. Pat. No. 4,843,739 to Blucher et al. (1989), carbon particles adhered in a punctiform manner to a textile fabric, or sandwiched between a textile fabric and a porous polyurethane sheet.

U.S. Pat. No. 4,864,740 to Oakley (1989) introduces a disposable odor adsorbing inner sole for short term use. It is composed of activated carbon containing pulp and polymer fibers as a composite layer sandwiched between an upper layer of spunbonded polyolefin or nylon non woven fibers which are embossed or saturated with a latex compound and a bottom breathable layer of a meltblown polyethylene vinyl acetate compound. Any of its three layers may contain activated carbon powder. While such inner sole does not act primarily by absorbing perspiration fluid, it lacks significant sized perforations in its embossed or latex saturated top layer to allow vapor existing within the shoegear access to the underlying activated carbon. It also lacks contour and is flat in shape.

OBJECTS OF THE INVENTION

Accordingly, several objectives and advantages of this invention are:

1. to produce an odor adsorbing inner sole which does not quickly expend the efficacy of its odor adsorbent material by becoming saturated with perspiration,
2. to produce such an inner sole which does not significantly interfere with perspiration escape from the shoe; the natural liquid to vapor phase chemistry of perspiration fluid within shoegear proceeds unimpeded,
3. to promote adsorption of odorous vapor within the interior confine of the footwear by means of a breathable upper surface which allows exposure to an odor adsorbent material,
4. to adsorb pre-existing odor directly from the saturated porous material lining the bottom of the shoe interior by means of presenting an odor adsorbent material into direct contact with such shoe bottom material,
5. to produce such an odor adsorbing inner sole which is contoured in shape to the general configuration of the bottom of the foot,
6. to produce such an odor adsorbing inner sole which is comprised in part of a solid, non-compressible contoured material, thereby providing some anatomical support to the foot structure and reducing symptoms of foot strain and fatigue suffered by many people,
7. to produce such an odor adsorbing inner sole which is capable of prolonged wear and usage.

Further objects and advantages of this invention will become apparent from a perusal of the drawings and the ensuing descriptions.

SUMMARY OF THE INVENTION

This inner sole laminate includes an upper-most contoured layer of a closed cell thermoplastic foam containing a myriad of perforations, an underlying contoured second layer of an air permeable, water repellent textile fabric, an underlying contoured layer of activated carbon or molecular sieve impregnated fabric, an underlying fourth layer of a solid thermoplastic compound contoured on its upper surface and flat on its lower surface whose length extends from its most posterior end to the anatomical area just proximal to the metatarsal heads, and an underlying bottom-most layer of activated carbon or molecular sieve impregnated fabric.

Unlike prior art, this invention does not substantially absorb perspiration fluid into itself. The perforated closed cell thermoplastic foam top covering is water repellent, yet still allows through its perforations and air permeable textile fabric under layer odor adsorption by the underlying chemical adsorbent layer. Saturation of the odor adsorbent material with perspiration fluid is de minimus when compared to prior art inner soles which quickly expend their activated carbon by such fluid absorption.

A brief discussion of liquid to vapor phase chemistry involving foot perspiration within shoegear is as follows. Perspiration originates from sweat glands located primarily on the bottom surface of the foot. Perspiration fluid is then transported by means of the stockingwear worn into different directions. One is the migration from the bottom of the stockingwear along its opposing surfaces to its upper surface where evaporation into a vapor phase occurs and such vapor escapes through the shoe material and open spaces into the atmosphere. The other is absorption from the perspiration fluid saturated bottom of the stockingwear into the porous material lining the bottom of the shoe. Repeated episodes of such saturation of perspiration fluid into the shoe bottom material result in an accumulation of various organic and inorganic compounds within the leather forming a medium for micro-organism growth and resulting odor production.

Prior art inner soles interfere with the natural wicking mechanism, i.e. transport of perspiration fluid from liquid to vapor phase, by absorbing into them such perspiration originating from the bottom of the foot. This invention allows the normal upward migration of perspiration fluid to proceed unimpeded and evaporate from the confine of the shoegear. It does so by virtue of its water repellent textile fabric and closed cell foam top-covering which is in contact with the bottom of the stockingwear. Thus, it prevents fluid saturation of its construction and also leaves the odor adsorbent material free to adsorb odorous vapor without quickly expending itself as a result of fluid absorption and saturation of its pores.

It is to be especially noted that the contoured section of this inner sole includes a layer of a solid non-compressible thermoplastic. Such layer is intended to provide anatomical support to the arch structure of the human foot and thereby differs substantially from the compressible foam contoured inner soles described in the prior art.

REFERENCE NUMERALS IN DRAWINGS

Figure 1:
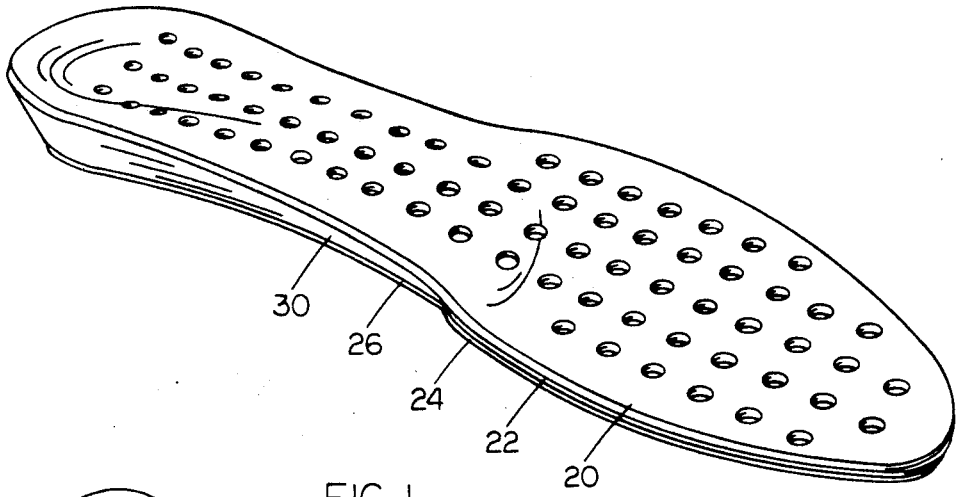
FIG. 1 shows the general configuration of the inner sole in its preferred embodiment.
Figure 2A:
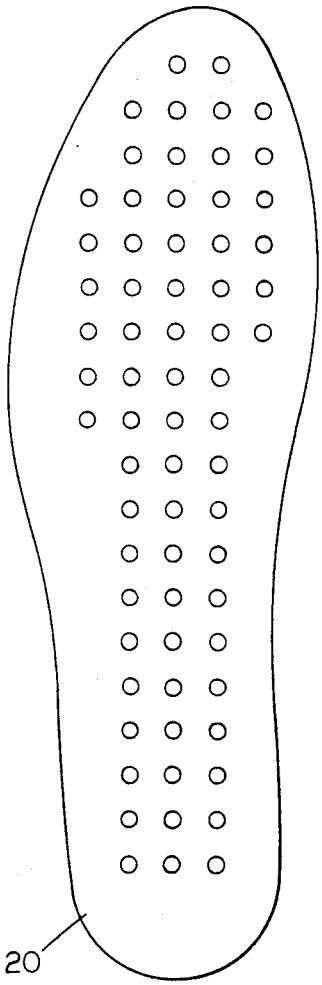
FIG. 2A to 2E show the inner sole and its layers from a top to bottom perspective.
Figure 2B:
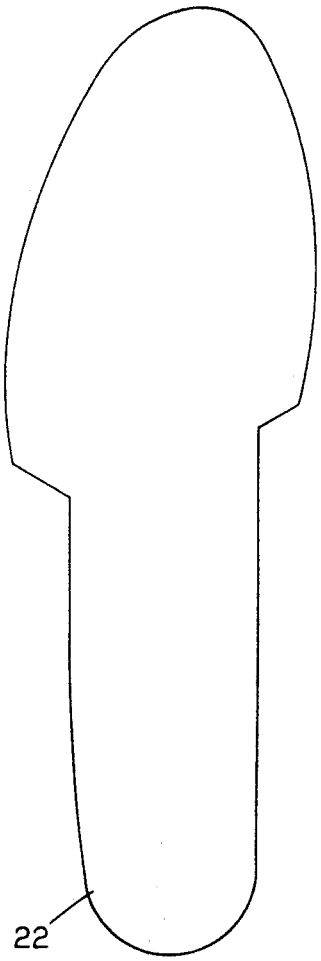
Figure 2C:
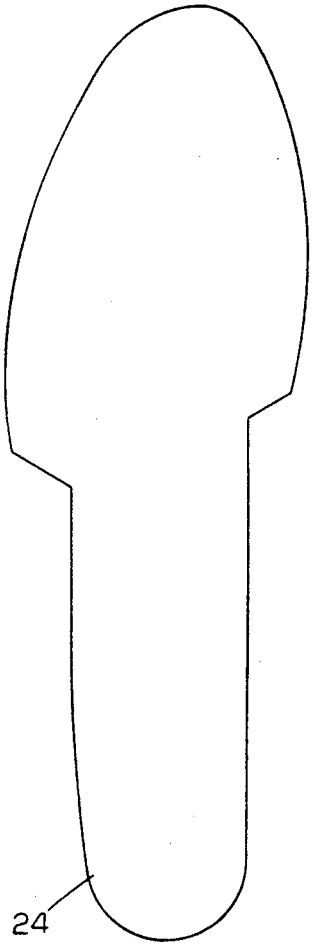
Figure 2D:
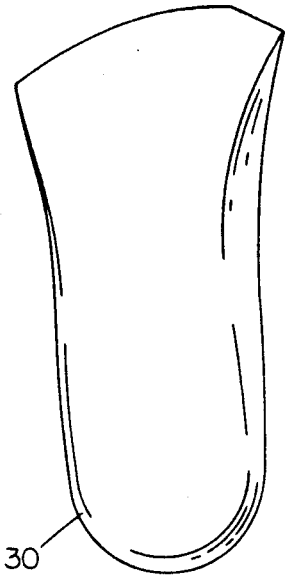
Figure 2E:
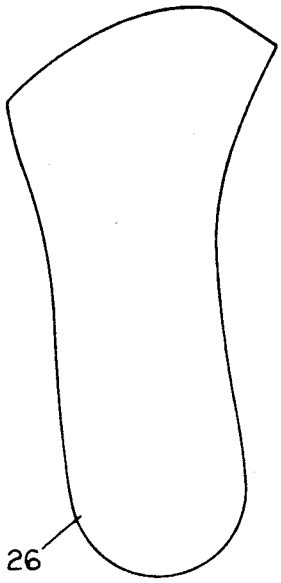
Figure 3:
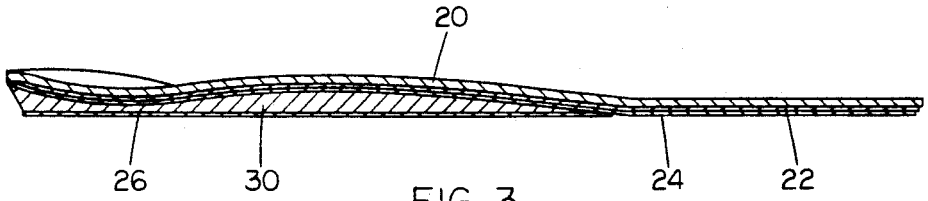
FIG. 3 shows the inner sole in cross section perspective.
Figure 4:
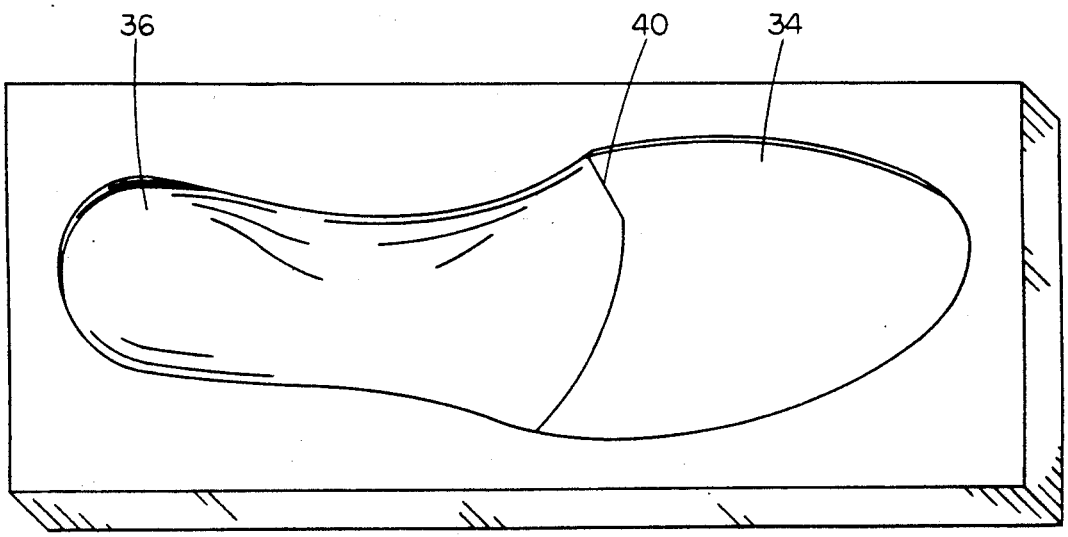
FIG. 4 shows an example of a blank mold used to fabricate the inner sole.

20 perforated thermoplastic foam
22 air permeable, water repellent textile fabric
24 odor adsorbent paper or synthetic fabric impregnated with activated carbon or molecular sieve compound.
26 odor adsorbent paper or synthetic fabric impregnated with activated carbon or molecular sieve compound.
30 solid thermoplastic compound
34 anterior flat section of the mold
36 posterior contoured section of the mold
40 line delineating flat and contoured sections of mold

DESCRIPTION OF A PREFERRED EMBODIMENT

A heat molding process is used to fabricate this laminate. The mold used 32 is contoured in negative to the general shape of the bottom of the foot from its most posterior end up to a site that corresponds to the anatomical area just proximal to the metatarsal heads; the mold at that location then assumes a flat configuration which extends to its most anterior end. It is helpful for the mold to have an extended area around the interior of its periphery to accommodate an oversize thermoplastic foam layer which will shrink during the heating process.

A layer of perforated thermoplastic foam 20 such as closed cell polyethylene foam manufactured by BXL Plastics Limited of England and commercially available under the trademark PLASTAZOTE foam is placed into the bottom of the mold.

Next, a layer of air permeable, water repellent textile fabric 22 is placed into the mold covering the foam layer 20, ranging from 0.5 cm to 3.0 cm. One such type of fabric which may be used is a polyester/acetate combination manufactured by a division of the Phillips-Van Heusen Corporation and commercially available under the trademark WINDBREAKER water repellent fabric. Within the posterior contoured cavity of the mold, the textile fabric 22 is narrower in diameter than the underlying foam layer 20 so that a uncovered area of the foam layer 20 exists along the course of the medial, posterior, and lateral periphery of the mold. In the flat anterior section of the mold, the textile layer 22 runs the approximate width and length of the underlying foam layer 20.

A layer of odor adsorbent material 24 containing either activated carbon or molecular sieve is then placed into the mold on top of the textile layer 22. One such example is an activated carbon containing paper manufactured by the James River Corp., Custom Papers Inc. Division, and identified by this manufacturer as CUSTOM-FYL AC paper. Another such example is an activated carbon containing polyester fabric manufactured by Columbus Industries and commercially available under the trademark POLYSORB activated carbon filter. Within the posterior contoured cavity of the mold, such odor adsorbent layer 24 is slightly narrower in diameter than the above described textile layer 22, ranging from 0.5 cm to 1.5 cm, so that a narrow uncovered area of the textile layer 22 and the foam layer 20 exists along the course of the medial, posterior, and lateral periphery of the mold. In the flat anterior section of the mold, the odor adsorbent layer 24 runs the approximate width and length of the textile layer 22 and the foam layer 20.

It is noted that, at times, it may be helpful to secure the odor adsorbent material 24 and textile material 22 to the foam layer 20 by use of a porous adhesive tape manufactured by 3M Corporation and commercially available under the trademark MICROPORE surgical adhesive tape.

Attention is then directed to the posterior contoured cavity of the mold. Pieces of a solid thermoplastic compound 30 are placed into the mold on top of the odor adsorbent material layer 24. Such solid thermoplastic may be selected from the group including ethylene vinyl acetate, polyester, polyamide, polyethylene, polypropylene, or mixtures or combinations of such compounds. One such preferred example which may be used is an ethylene vinyl acetate and wax mixture commercially available in many retail stores in rod or stick form and commonly known as HOT MELT GLUE sticks.

In one preferred embodiment, the mold and its contents are then heated in an oven until the solid thermoplastic compound 30 has melted and flowed to fill the contoured cavity section of the mold. The mold and its contents are then removed from the oven and the contained thermoplastic melt is covered with a layer of odor adsorbent material 26, upon which a compression plate is placed until the melt cools and re-solidifies. In an alternative preferred embodiment, the solid thermoplastic is heat melted outside the mold and then poured into the posterior contoured cavity of the mold where it flows to fill such cavity and is then covered with a layer of odor adsorbent material 26 and a compression plate.

When sufficient cooling has taken place, the contents of the mold are removed from the mold, any flashing-/excess material is trimmed away, and a narrow rim of adhesive may be applied along the anterior periphery of the foam layer 20 to the textile layer 22 and textile layer 22 to the odor adsorbent material layer 24.

What is produced is a multi-layered laminate contoured to the general shape of the bottom of the human foot and including an upper-most layer of perforated thermoplastic foam 20, an underlying second layer of air permeable, water repellent textile fabric 22, a third layer of odor adsorbent material 24, a fourth layer of solid thermoplastic 30 which extends in length only the distance from its most posterior end to a site corresponding to the anatomical area just proximal to the metatarsal heads, and a fifth bottom layer of odor adsorbent material 26, whereby such inner sole can provide anatomical structural support to the foot and is capable of adsorbing odor while repelling absorption of perspiration fluid.

Although the described embodiment and disclosure of this invention enumerates detailed materials and method of construction, this should not be construed as limiting the scope of the invention. Instead, this should be viewed as only a preferred embodiment of currently feasible materials and methods. For example, the odor adsorbent material, activated carbon, is widely used in the water filtration and air filtration industries and, accordingly, is contained in paper or synthetic fabrics most useful to these industries. It would be desirable to find such odor adsorbent material in a more appropriate textile or apparel industry fabric. Another example is that while this invention is fabricated by a heat molding compression process, it would likewise be desirable to use an injection molding process for construction of this laminated inner sole. Another example is embodiment of this invention in various forms and sizes without departing from the spirit and scope of the invention as appended in the following claims.

What is claimed is:

1. A multi-layered contoured laminate for footwear comprising:

a. a layer of perforated thermoplastic foam as its upper-most surface which is contoured to the general shape of the bottom of the foot and includes a heel cup and arch support layer, and b. an underlying second layer of air permeable, water repellent textile fabric whose upper surface contacts the lower surface of said foam layer and conforms in contour to said foam layer, and c. an underlying third layer of breathable, odor adsorbent material whose upper surface contacts the lower surface of said above described textile fabric and conforms in contour to said above described textile layer and foam layer, and d. an underlying fourth layer of solid thermoplastic whose upper surface is affixed to the lower surface of said above described odor adsorbent layer and whose upper surface is also affixed to the medial, posterior, and lateral periphery borders of the lower surfaces of said above described overlying textile layer and overlying foam layer, and conforms in contour on its upper surface to said layers, but extends in length only the distance from its most posterior end distally to a site corresponding to the anatomical area just proximal to the metatarsal heads, and is flat rather than contoured on its lower surface, and e. an underlying flat fifth layer of breathable, odor adsorbent material whose upper surface is affixed to the lower surface of said above described solid thermoplastic fourth layer.

2. The laminate of claim one where said thermoplastic foam is one selected from the group including polyethylene, polypropylene, ethylene vinyl acetate, or polyurethane compounds.

3. The laminate of claim two where said thermoplastic foam has a myriad of perforations punched through it.

4. The laminate of claim one where said textile fabric is one selected from the group including air permeable, water repellent fabrics such as nylon, polyester, acetate, polyolefin, or combinations of such materials.

5. The laminate of claim one where said textile fabric in its heel cup and arch areas ranges from 0.5 cm. to 3.0 cm. narrower in diameter than said thermoplastic foam layer.

6. The laminate of claim one where said odor adsorbent material is one selected from the group including odor adsorbents known as activated carbon or molecular sieves

7. The laminate of claim one where said odor adsorbent layer in its heel cup and arch areas ranges from 0.5 cm. to 1.5 cm. narrower in diameter than said textile fabric.

8. The laminate of claim one where said solid thermoplastic is one selected from the group including ethylene vinyl acetate, polyester, polyamide, polyethylene, polypropylene, or combinations or mixtures of such compounds.

* * * * *